US008672029B2

(12) United States Patent
Goddard et al.

(10) Patent No.: US 8,672,029 B2
(45) Date of Patent: Mar. 18, 2014

(54) SYSTEM FOR REDUCING FOAM IN MIXING OPERATIONS

(75) Inventors: Brian Goddard, Sugar Land, TX (US); Josh Rayner, Houston, TX (US); Michael Woodmansee, Houston, TX (US); Philip Zsiga, Tulsa, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 188 days.

(21) Appl. No.: 12/649,708

(22) Filed: Dec. 30, 2009

(65) Prior Publication Data

US 2011/0155373 A1 Jun. 30, 2011

(51) Int. Cl.
*E21B 33/13* (2006.01)
*B01F 5/12* (2006.01)

(52) U.S. Cl.
USPC ..... 166/285; 366/172.1; 366/190; 366/263; 366/51

(58) Field of Classification Search
USPC ..... 366/51, 64, 65, 190, 262–265, 168.1, 366/172.1; 95/241–266; 96/217; 166/285
See application file for complete search history.

(56) References Cited

U.S. PATENT DOCUMENTS

| | | | | | |
|---|---|---|---|---|---|
| 2,908,652 | A * | 10/1959 | Forrester | 95/242 |
| 3,638,919 | A * | 2/1972 | Phipps | 366/262 |
| 3,704,865 | A * | 12/1972 | Kharitonov et al. | 366/77 |
| 4,421,022 | A * | 12/1983 | Burgin | 100/98 R |
| 4,472,061 | A * | 9/1984 | Mansour | 366/98 |
| 4,499,562 | A * | 2/1985 | Campolini et al. | 366/264 |
| 4,534,654 | A * | 8/1985 | Alt et al. | 366/137 |
| 4,805,154 | A * | 2/1989 | Schneider | 366/303 |
| 5,005,364 | A * | 4/1991 | Nelson | 62/76 |
| 5,103,908 | A * | 4/1992 | Allen | 166/285 |
| 5,221,512 | A | 6/1993 | Sancinelli | |
| 5,355,951 | A * | 10/1994 | Allen et al. | 166/253.1 |
| 5,522,459 | A * | 6/1996 | Padgett et al. | 166/285 |
| 5,570,743 | A * | 11/1996 | Padgett et al. | 166/285 |
| 5,624,058 | A * | 4/1997 | Bailey | 222/240 |
| 6,375,271 | B1 | 4/2002 | Young, III | |
| 6,962,618 | B2 * | 11/2005 | Gaus et al. | 95/242 |
| 7,462,225 | B1 * | 12/2008 | Ketter et al. | 96/217 |
| 7,464,757 | B2 * | 12/2008 | Pessin et al. | 166/285 |
| 7,604,052 | B2 | 10/2009 | Roes et al. | |
| 7,740,447 | B2 * | 6/2010 | Pessin et al. | 415/206 |
| 7,967,498 | B2 * | 6/2011 | Van Den Berg | 366/136 |
| 2004/0171499 | A1 | 9/2004 | Ravi et al. | |
| 2007/0144739 | A1 * | 6/2007 | Fitzgerald | 166/250.14 |
| 2007/0289737 | A1 * | 12/2007 | Pessin et al. | 166/250.01 |

(Continued)

FOREIGN PATENT DOCUMENTS

| | | | | |
|---|---|---|---|---|
| DE | 3238647 | A1 * | 5/1984 | B01F 5/12 |
| EP | 0242361 | | 9/1991 | |

(Continued)

*Primary Examiner* — Charles E Cooley

(57) ABSTRACT

A technique facilitates mixing operations by removing foaming that results from air entrained during mixing of constituents. A mixing system comprises a container body having an interior and an inlet through which material enters the interior for mixing. The container body also comprises a discharge through which the mixed material is delivered downstream. A mechanical foam breaker is disposed within the container body and extends upwardly a sufficient distance to extend through a surface level to which the material rises during mixing within the container body. The mechanical foam breaker is oriented to break down foam along the surface of the material as the material moves through the interior.

17 Claims, 2 Drawing Sheets

(56) References Cited

U.S. PATENT DOCUMENTS

| | | | | |
|---|---|---|---|---|
| 2008/0166218 | A1* | 7/2008 | Pessin et al. | 415/2.1 |
| 2009/0257303 | A1* | 10/2009 | Rayner et al. | 366/8 |
| 2009/0262598 | A1 | 10/2009 | Brashears | |
| 2011/0155373 | A1* | 6/2011 | Goddard et al. | 166/285 |
| 2012/0031619 | A1* | 2/2012 | Goddard et al. | 166/309 |
| 2013/0248182 | A1* | 9/2013 | Chong et al. | 166/285 |

FOREIGN PATENT DOCUMENTS

| | | |
|---|---|---|
| WO | 8603505 | 6/1986 |
| WO | 2005051299 | 6/2005 |
| WO | 2005061846 | 7/2005 |
| WO | 2010039575 | 4/2010 |

* cited by examiner

SYSTEM FOR REDUCING FOAM IN MIXING OPERATIONS

BACKGROUND

In many cement mixing applications, dry cement powder is conveyed pneumatically, and significant quantities of the associated air becomes entrained within the mixed cement slurry. This entrained air creates adverse mixing conditions, including inaccurate slurry density measurements, higher frictional pressures, and potential loss of prime in pumps used to move the cement slurry. Entrained air also can cause significant foaming along a surface of the mixed cement slurry.

Entrainment and foaming are sometimes controlled through the use of chemicals. In other applications, entertainment and foaming are reduced by circulating fluid through a centrifugal separator by which some of the entrained air is exhausted. In many applications, however, addition of chemicals can be detrimental, and centrifugal separators are not able to reduce foam on the fluid slurry surface.

SUMMARY

In general, the present invention provides a system and methodology for removing foaming that results from entrained air. A mixing system comprises a container body having an interior and an inlet through which material enters the interior for mixing and/or homogenization. The container body also comprises a discharge through which the mixed material is delivered downstream for use in a given operation, e.g. a cementing operation. A mechanical foam breaker is disposed within the container body and extends upwardly a sufficient distance to extend through an upper surface level to which the material may rise during mixing within the container body. The mechanical foam breaker is able to break down foam along the surface of the material during operation of the mixing system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology to facilitate mixing of a variety of constituents by reducing or eliminating detrimental effects of entrained air. For example, the technique may be used to reduce or eliminate entrained air and foaming in cement slurries and other fluids to allow for more accurate density measurements, to minimize frictional pressures, to reduce difficulty in mixing, and/or to improve other aspects related to the mixing/homogenizing and delivery of a variety of slurries. The mixing technique is useful in many well related applications, e.g. oil and gas well related applications, but also in other industrial applications, such as papermaking.

According to one embodiment, the system and methodology utilizes a container body, e.g. a mixing tub, which incorporates a mechanism for mechanically breaking up foam. The container body is designed to promote the flow of fluid at a fluid surface toward the mechanical foam breaker, which may comprise a rotating member, such as a rotating shaft. In one configuration, the container body receives materials to be mixed, e.g. fluid to be mixed and/or homogenized, at an inlet positioned proximate a bottom of the container body. From the inlet, the fluid flows along the bottom of the container body which slopes upwardly toward a wall which returns the fluid flow back toward the mechanical foam breaker, e.g. a rotating shaft.

In one embodiment, the rotating shaft extends generally upwardly through a fluid surface from a discharge port. A centrifugal pump may be coupled to the discharge such that a suction side of the centrifugal pump draws mixed fluid from the discharge. In some applications, the rotating shaft may drive the centrifugal pump or be driven by the centrifugal pump. Regardless, the movement of mixed fluid to the discharge facilitates circulation of surface foam to the rotating shaft or other mechanical foam breaker which breaks down the bubbles as they come into contact with the rotating member.

Figure 1:
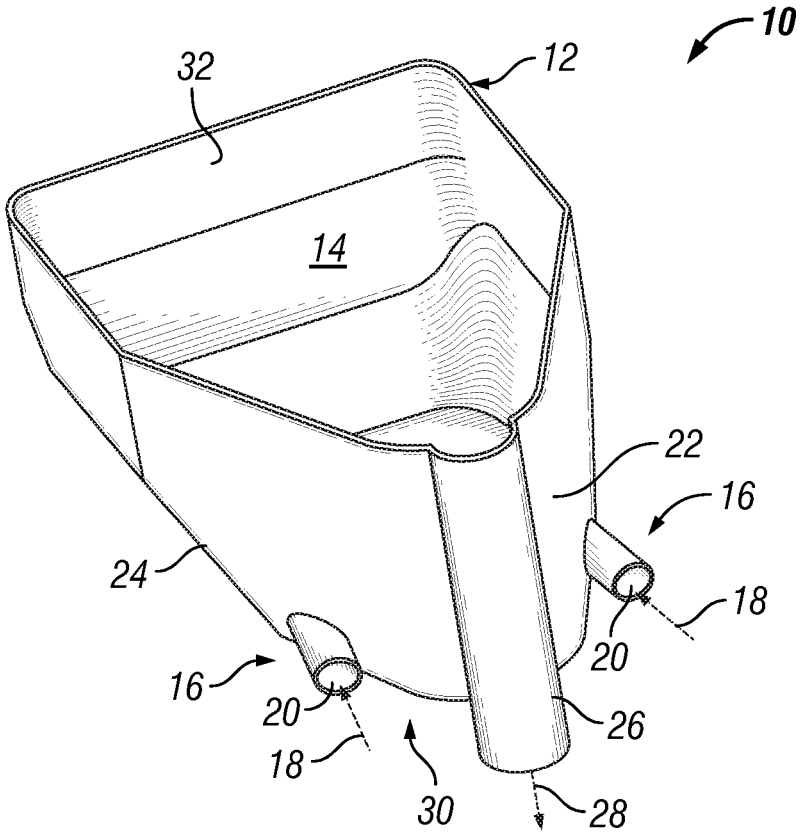
FIG. 1 is an orthogonal view of one embodiment of a container body that may be used in a mixing system, according to an embodiment of the present invention.

Referring generally to FIG. 1, a mixing system 10 comprises a mixing tub or container body 12 designed for thoroughly mixing material to form a mixed/homogenized material, e.g. slurry, that can be used in a desired process. The container body 12 comprises an interior 14 and an inlet 16 through which material enters interior 14, as represented by arrows 18. In the example illustrated, inlet 16 is formed with a pair of inlet openings or passages 20 which extend through a side wall 22 proximate a bottom or floor 24 of the container body 12. However, the actual number, size and arrangement of inlet openings may vary from one application to another.

The container body 12 also comprises a discharge 26 through which the mixed liquid/slurry is discharged from interior 14, as represented by arrow 28. In the example illustrated, the inlet 16 and discharge 26 are located generally along bottom 24 at a common end 30 of container body 12. Additionally, the embodiment illustrated in FIG. 1 has an upwardly sloping bottom 24 which slopes upwardly as it moves away from inlet 16 toward a back wall 32. The upwardly sloping orientation of bottom 24 facilitates mixing of the materials entering through inlet 16. For example, by introducing slurry materials through inlet 16 from a pressurized source, the materials 18 flow upwardly toward back wall 32 which changes the flow direction back toward common end 30 and, ultimately, to discharge 26. This motion of the energized material flow provides a substantial mixing action.

The inlet passages 20 may be arranged such that the angle of injection into interior 14 of container body 12 creates a mild incidence angle with the upwardly sloping bottom 24. In this example, circulation through interior 14 is driven by the kinetic energy of fluid entering interior 14 through inlet 16.

Figure 2:
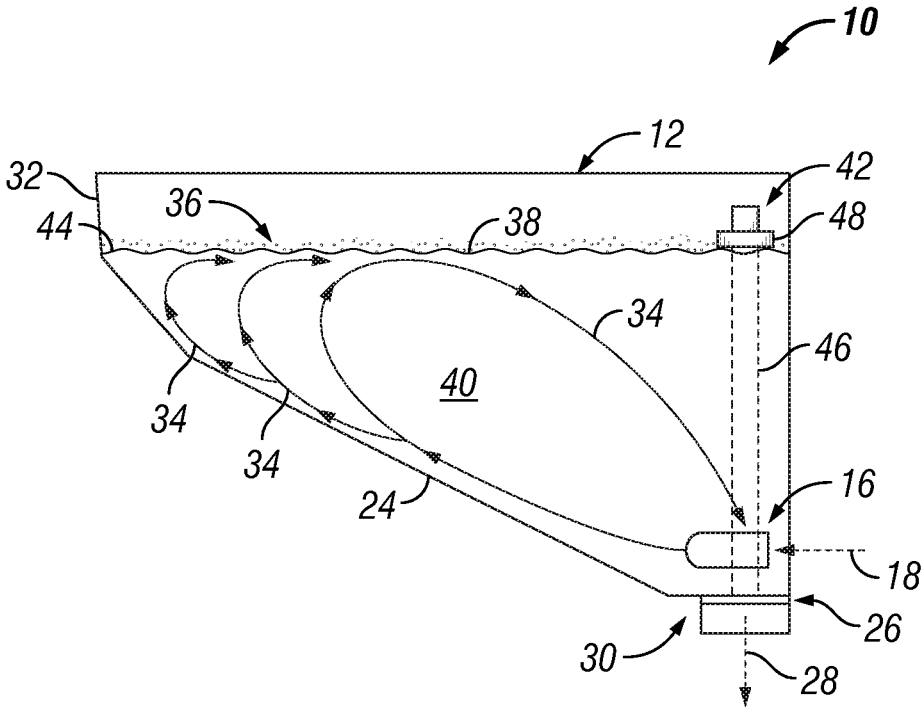
FIG. 2 is a schematic illustration of the path of flow along which materials move through one embodiment of the container body between an inlet and a discharge, according to an embodiment of the present invention.

The upwardly sloping bottom 24 and its transition to back wall 32 creates a circulation pattern, as indicated schematically in FIG. 2 by the schematic circulation lines 34. The configuration may be designed to place the entire volume of fluid within container body 12 into motion while also providing a uniform residence time within interior 14 before exiting through discharge 26.

The circulation of materials upwardly along bottom 24 and back toward discharge 26 along circulation lines 34 substantially reduces air entrainment. However, depending on the types of materials mixed in container body 12 and on the actual configuration of container body 12, foaming 36 may still occur along a surface 38 of the mixed fluid/slurry 40. Accordingly, a mechanical foam breaker 42 is disposed in interior 14 and oriented to extend through a surface level 44 of container body 12. Surface level 44 is the level to which mixed fluid surface 38 rises during operation of mixing system 10. Consequently, the flow of fluid along circulation lines 34 delivers foam 36 toward mechanical foam breaker 42, and the mechanical foam breaker 42 is able to break down the bubbles, thus substantially reducing or eliminating the undesirable foam 36.

By way of example, mechanical foam breaker 42 comprises a rotatable member 46 which may be in the form of a shaft extending upwardly through surface level 44. The rotatable member 46, e.g. shaft, comprises a foam reduction feature 48 which breaks down the foam 36 as it is delivered to the rotatable member 46. The foam reduction feature 48 may comprise a variety of paddles, protuberances, recesses, uneven features, or other types of features able to break down the foam 36. In one embodiment, for example, the foam reduction feature 48 comprises an abrasive shaft surface which eliminates the bubbles of foam 36 as the rotatable member 46 is rotated. In the embodiment illustrated in FIG. 2, rotatable member 46 is located within interior 14 at common end 30 and extends upwardly from discharge 26.

Figure 3:
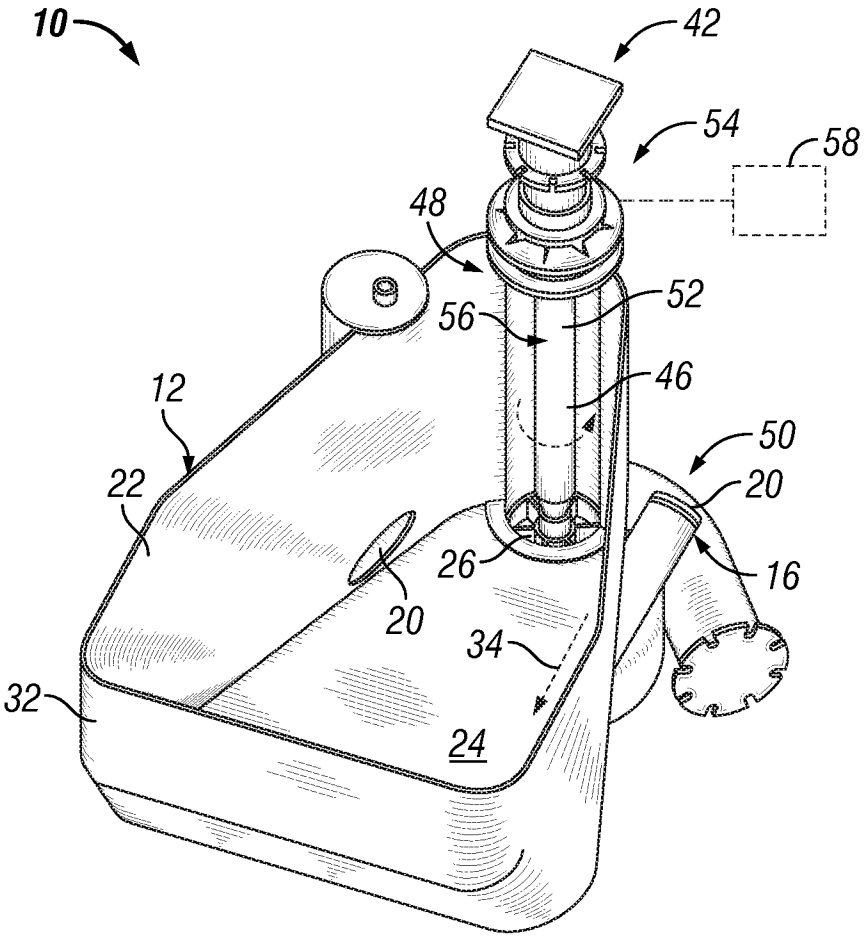
FIG. 3 is an orthogonal view of one embodiment of a mixing system designed to reduce foam along a surface of the mixed liquid, according to an embodiment of the present invention.

Referring generally to FIG. 3, an embodiment of mixing system 10 is illustrated in which a pump 50, e.g. a centrifugal pump, is operatively connected with container body 12. For example, a suction side of centrifugal pump 50 may be coupled with discharge 26 of container body 12. In one embodiment, the rotatable member 46 is connected to centrifugal pump 50 and powers the centrifugal pump. As illustrated, rotatable member 46 comprises a shaft 52 which is drivingly coupled with centrifugal pump 50 through discharge 26. The shaft 52 extends upwardly through interior 14 and past surface level 44 for engagement with an upper mounting assembly 54. In this example, the foam reduction feature 48 may be an abrasive surface 56 of shaft 52.

Although a variety of container body configurations may be employed with mechanical foam breaker 42 and pump 50, the embodiment illustrated in FIG. 3 utilizes container body 12 as described with reference to FIG. 1. This style of container body may be designed without dead spaces and in a manner that promotes a first in, first out capability. As fluid enters the container body 12 through inlet 16, the fluid is directed along the upwardly sloping bottom 24 towards back wall 32. The upwardly sloping bottom 24 and the generally vertical back wall 32 (along with any transition sections therebetween) cooperate to move the flowing fluid upwardly and to redirect the flowing fluid back toward the common end 30. The shaft 52 is rotated within the container body 12 along the path of returning fluid, and this returning fluid moves the foam 36 toward foam reduction feature 48.

In the example illustrated, shaft 52 is connected to centrifugal pump 50 which is mounted horizontally at the suction discharge 26 of container body 12. In this embodiment, shaft 52 is rotated by a suitable power source, e.g. an electric or hydraulic motor 58, which may be coupled to shaft 52 at upper mounting assembly 54 to impart rotational motion to shaft 52. The rotating shaft transfers this power to centrifugal pump 50, thereby causing the centrifugal pump to draw mixed fluid through discharge 26 and to pump the mixed fluid to a desired location, e.g. a desired wellbore location. Any foam 36 created in the mixed fluid, e.g. cement slurry, is moved at surface 38 toward rotating shaft 52. When the foam bubbles contact the shaft 52, the bubbles are broken down into smaller bubbles or eliminated by the abrasive surface 56, and the air within the foam dissipates into the surrounding air. The process may be continued until all of the air has been removed from the mixed fluid.

Figure 4:
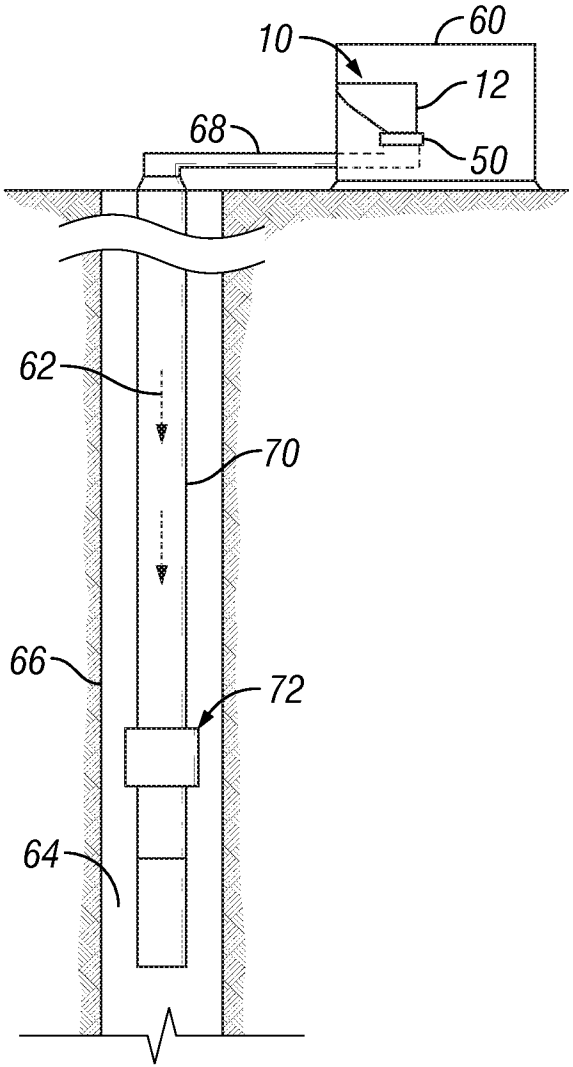
FIG. 4 is a schematic illustration of a well cementing application incorporating a foam reducing mixing system, according to an embodiment of the present invention.

The mixing system 10 may be used to remove air or other entrained gases from a variety of fluid mixtures. The system and technique also may be employed to reduce or eliminate foaming in many types of applications. However, one operational example is illustrated in FIG. 4 in which the mixing system 10 is incorporated into a cement slurry system 60 used to mix and deliver a cement slurry 62 downhole to a desired cementing location 64 in a wellbore 66.

Mixing system 10 is employed to remove entrained air and the resulting foam 36 during mixing of the cement slurry and prior to pumping the slurry downhole into wellbore 66. After passing through mixing system 10, centrifugal pump 50 delivers a higher quality slurry to wellbore 66 via tubing 68. The slurry 62 is then pumped downhole through an annulus or appropriate well tubing 70, e.g. coiled tubing, to a service tool 72. The service tool 72 is designed to properly deliver the cement slurry for performance of the desired cementing operation. It should be noted, however, that mixing system 10 can be used with a wide variety of cement slurry mixing and delivery systems to accommodate many types of well related cementing operations.

The actual configuration of mixing system 10 may be adjusted according to the specific application and materials being mixed. For example, the configuration of the container body may be changed to accommodate material differences between mixing cement slurry materials and other types of slurry materials for other types of applications. Additionally, the mechanical foam breaker 42 may be powered by the same power source used to power the pump 50 or by an alternate power source. The mechanical foam breaker also may comprise a variety of shafts or other rotatable components with various types of foam reduction features depending and the materials being mixed. Similarly, the number and orientation of the inlet openings and discharge openings may be changed to accommodate the specific parameters of a given application.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system, comprising:

a container body having an interior, an inlet through which material enters the interior, and a discharge through which the material is delivered downstream, wherein the inlet is disposed through a side wall of the container body proximate a bottom of the container body, and wherein the bottom of the container body slopes upwardly as it extends away from the inlet; and a mechanical foam breaker having at least a portion thereof disposed in the interior of the container body, the mechanical foam breaker comprising a rotatable foam reduction member positioned above the inlet and the discharge, wherein the mechanical foam breaker being positioned to break down foam along a surface of the material as the material moves through the interior of the container body.

2. The system as recited in claim 1, further comprising a centrifugal pump having a suction side coupled to the discharge.

3. The system as recited in claim 2, wherein the mechanical foam breaker comprises a shaft extending upwardly through the container from the centrifugal pump.

4. The system as recited in claim 3, wherein the shaft is rotated to power the centrifugal pump.

5. The system as recited in claim 3, wherein the shaft has a mixing feature in the form of an abrasive shaft surface.

6. The system as recited in claim 1, wherein the inlet and the discharge are on a common end of the container body.

7. The system as recited in claim 6, further comprising a centrifugal pump coupled to the discharge, wherein the centrifugal pump is positioned below the bottom of the container body.

8. A cement slurry mixing system, comprising:

a container body having an interior, an inlet through which a slurry material is introduced into the interior of the container body, and a discharge through which a mixed slurry is directed downstream wherein the inlet is disposed through a side wall of the container body proximate a bottom of the container body, and wherein the bottom of the container body slopes upwardly as it extends away from the inlet;

a centrifugal pump coupled to the discharge;

a mechanical foam breaker having at least a portion thereof disposed in the interior of the container body, the mechanical foam breaker comprising a rotatable member; and a foam reduction member coupled to an end portion of the rotatable member, the foam reduction member positioned above the inlet and the discharge and being capable of breaking down foam along a surface of the slurry material as the slurry material moves through the interior of the container body.

9. The system as recited in claim 8, wherein the rotatable member is a shaft coupled to the centrifugal pump.

10. The system as recited in claim 9, wherein the discharge is through a bottom of the container body and the shaft extends upwardly from the discharge.

11. The system as recited in claim 8, wherein the bottom of the container body slopes upwardly from the discharge.

12. A method, comprising:

providing a container body having an interior with an inlet and a discharge;

delivering a material into the interior of the container body through the inlet, wherein the inlet is disposed through a side wall of the container body proximate a bottom of the container body, and wherein the bottom of the container body slopes upwardly as it extends away from the inlet;

mixing the material;

positioning a mechanical foam breaker in the container body such that at least a portion of the mechanical foam breaker extends through a surface of the material, and wherein the mechanical foam breaker comprises a rotatable foam reduction member positioned above the inlet and the discharge; and rotating the mechanical foam breaker to break down foam along the surface of the material as the material moves through the interior of the container body.

13. The method as recited in claim 12, further comprising coupling a centrifugal pump to the discharge.

14. The method as recited in claim 12, wherein mixing comprises mixing a cement slurry.

15. The method as recited in claim 14, further comprising delivering the cement slurry downhole into a wellbore.

16. The method as recited in claim 12, wherein positioning comprises orienting the mechanical foam breaker to extend upwardly from the discharge.

17. The method as recited in claim 12, wherein the inlet comprises a pair of inlet openings.

* * * * *